US006247333B1

(12) United States Patent
Rieth et al.

(10) Patent No.: US 6,247,333 B1
(45) Date of Patent: Jun. 19, 2001

(54) PROCESS FOR SUPPLYING IMPURE OXYGEN TO A SYNTHESIS-GAS PRODUCTION UNIT

(75) Inventors: Norbert Rieth; François De Bussy, both of Paris (FR)

(73) Assignee: L'Air Liquide, Societe Anonyme pour l'Etrude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/384,981

(22) Filed: Aug. 30, 1999

(30) Foreign Application Priority Data

Aug. 28, 1998 (FR) ..... 98 10813

(51) Int. Cl.[7] ..... F25J 3/00
(52) U.S. Cl. ..... 62/648; 62/524
(58) Field of Search ..... 62/643, 924, 648

(56) References Cited

U.S. PATENT DOCUMENTS 4,863,707 * 9/1989 McShea et al. ..... 423/359
5,704,228 1/1998 Tranier .
5,775,128 * 7/1998 Drnevich et al. ..... 62/632

FOREIGN PATENT DOCUMENTS 0 367 428 5/1990 (EP) .
0 531 182 3/1993 (EP) .
0 562 893 9/1993 (EP) .
0 636 845 2/1995 (EP) .
0 773 416 5/1997 (EP) .
0 793 070 9/1997 (EP) .

* cited by examiner

*Primary Examiner*—William Doerrler
(74) *Attorney, Agent, or Firm*—Young & Thompson

(57) ABSTRACT

Impure oxygen containing 70 to 98% oxygen and less than 2% argon is supplied to a synthesis-gas production unit (3*a*) which supplies hydrogen to an ammonia-production unit (7*a*). The same air-separation device (1*a*) can supply the nitrogen (9) to the ammonia-production unit and impure oxygen (2*a*) to the synthesis-gas production unit.

7 Claims, 4 Drawing Sheets

PROCESS FOR SUPPLYING IMPURE OXYGEN TO A SYNTHESIS-GAS PRODUCTION UNIT

Figure 1:
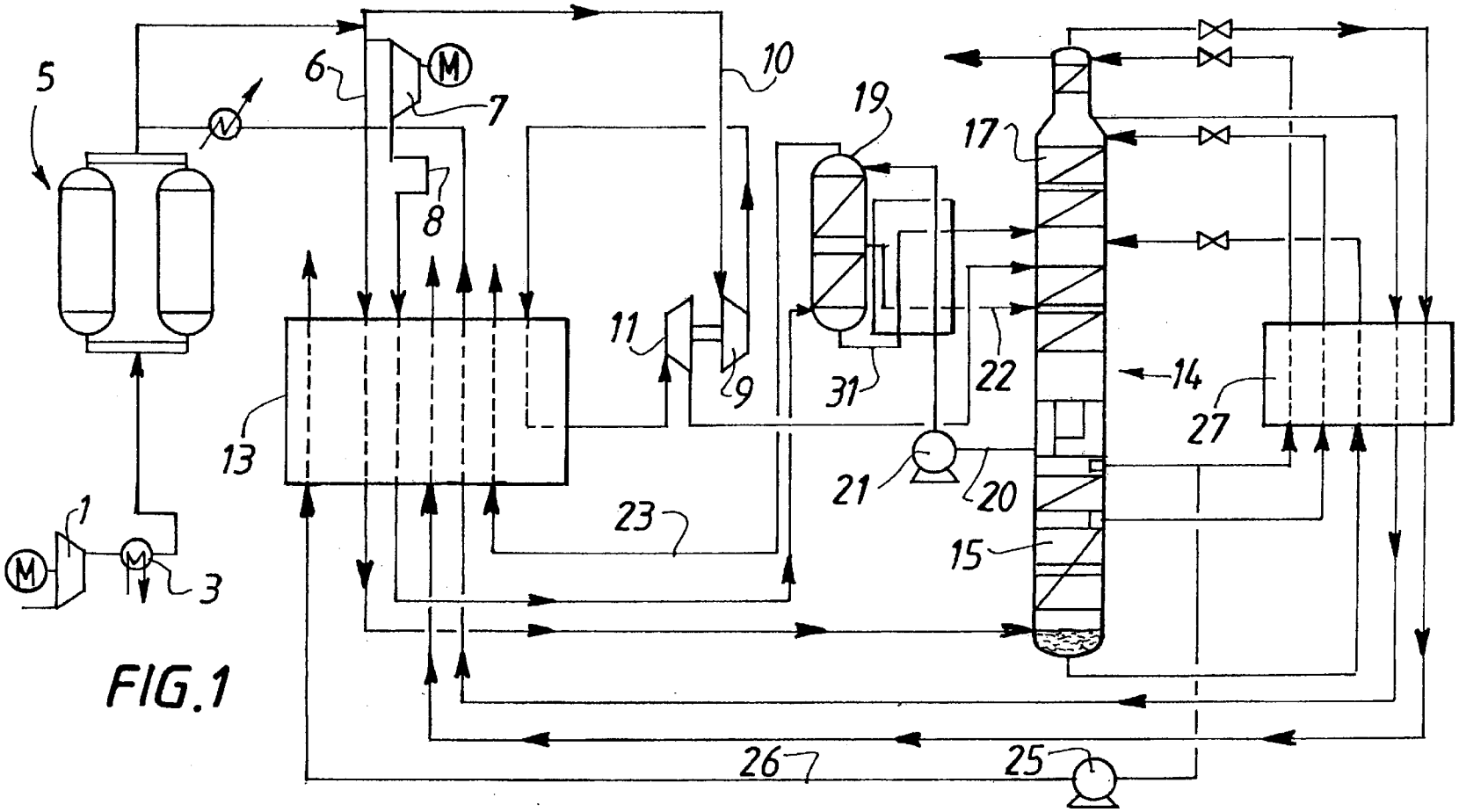

The present invention relates to a process and for producing impure oxygen by distillation Zr.

Impure oxygen is often used for the production of synthesis gas by partial oxidation or by reforming. The synthesis gas is separated by PSA in order to produce hydrogen, which is mixed with nitrogen for the synthesis of ammonia.

Impure oxygen typically contains 1 to 5% argon. This argon accumulates in the synthesis loop and can cause ammonia production losses and possible pollution when purging.

J-B-74023997 describes the use of an air-separation device for supplying oxygen and nitrogen to an ammonia-production unit.

EP-A-0562893 describes a process using a double column for producing nitrogen containing less than 10 ppm oxygen for an ammonia-manufacturing unit and oxygen with medium to high purity, that is to say 95 to 99.5% by mole for the production of hydrogen by reacting oxygen with heavy hydrocarbons, the hydrogen being intended to feed the same ammonia-manufacturing unit.

The problem associated with the presence of argon can clearly be avoided by using oxygen with a purity in excess of 99% oxygen, containing less than 1% argon, but this increases production costs.

A process of this type is described in application FR 97 04083 in the name of the Applicant Company, which has not yet been published.

It is known to produce impure oxygen using a double column and a mixing column.

EP-A-0636845 describes a process in which oxygen pumped from a double column is sent to the head of a mixing column. The process uses an intermediate-pressure column of the type referred to as an Etienne column fed with rich liquid from the medium-pressure column, and produces oxygen at 30 bar with 95% oxygen, 2% nitrogen and 3% argon.

EP-A-0531182 discloses a process using a mixing column operating at a pressure different from that of the medium-pressure column in order to produce oxygen having a purity between 80 and 97% oxygen.

U.S. Pat. No. 5,490,391 describes a process using a double column and a mixing column with a Claude turbine to refrigerate the device.

According to one subject of the invention, a process is provided for supplying impure oxygen to a synthesis-gas production unit whose synthesis gas is separated into a hydrogen-enriched part intended for an ammonia-synthesis unit, characterized in that the impure oxygen comes from a device for separating air by cryogenic distillation and contains 70 to 98% oxygen and less than 2% argon.

The impure oxygen preferably contains 1 to 30% nitrogen.

If the impure oxygen contains between 75 and 85% oxygen, it contains 15 to 25% nitrogen and less than 2% argon.

In a process for separation of air in order to produce impure oxygen, air is sent to a medium-pressure column of a double column of the air-separation device, an oxygen-enriched liquid and a nitrogen-enriched liquid are sent from the medium-pressure column to a low-pressure column of the double column, air is sent to the base of a mixing column, an oxygen-enriched liquid is sent from the low-pressure column to the head of the mixing column and the impure oxygen is drawn off as product from the head of the mixing column.

The synthesis-gas production unit may be a reforming or partial-oxidation device.

According to another subject of the invention, a process is provided for supplying impure oxygen to a synthesis-gas production unit whose synthesis gas is separated into a hydrogen-enriched part intended for an ammonia-synthesis unit and for supplying nitrogen to the ammonia-synthesis unit, characterized in that the impure oxygen and the nitrogen come from a device for separating air by cryogenic distillation and the impure oxygen contains 70 to 98% oxygen and less than 2% argon.

Figure 2:
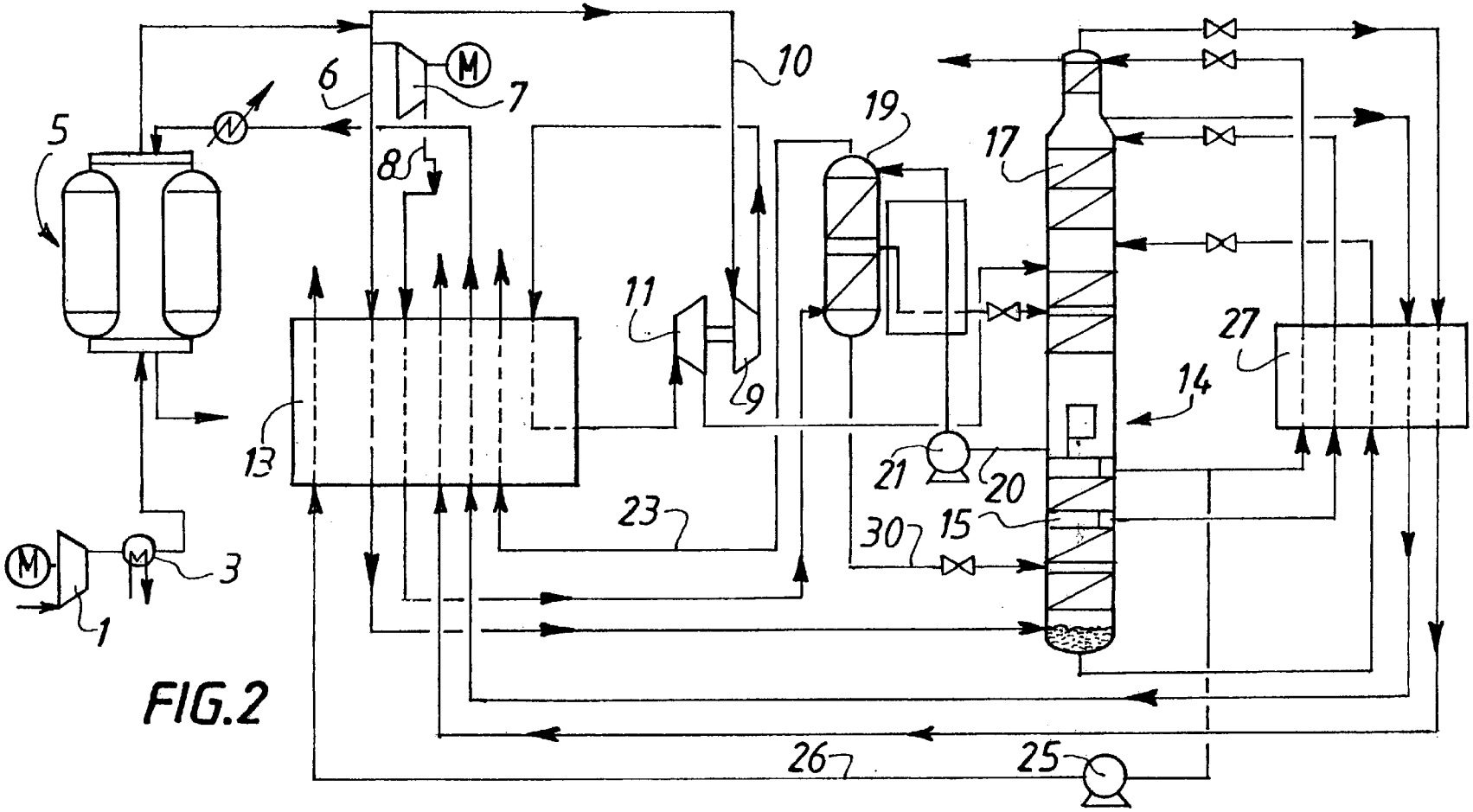
Figure 3:
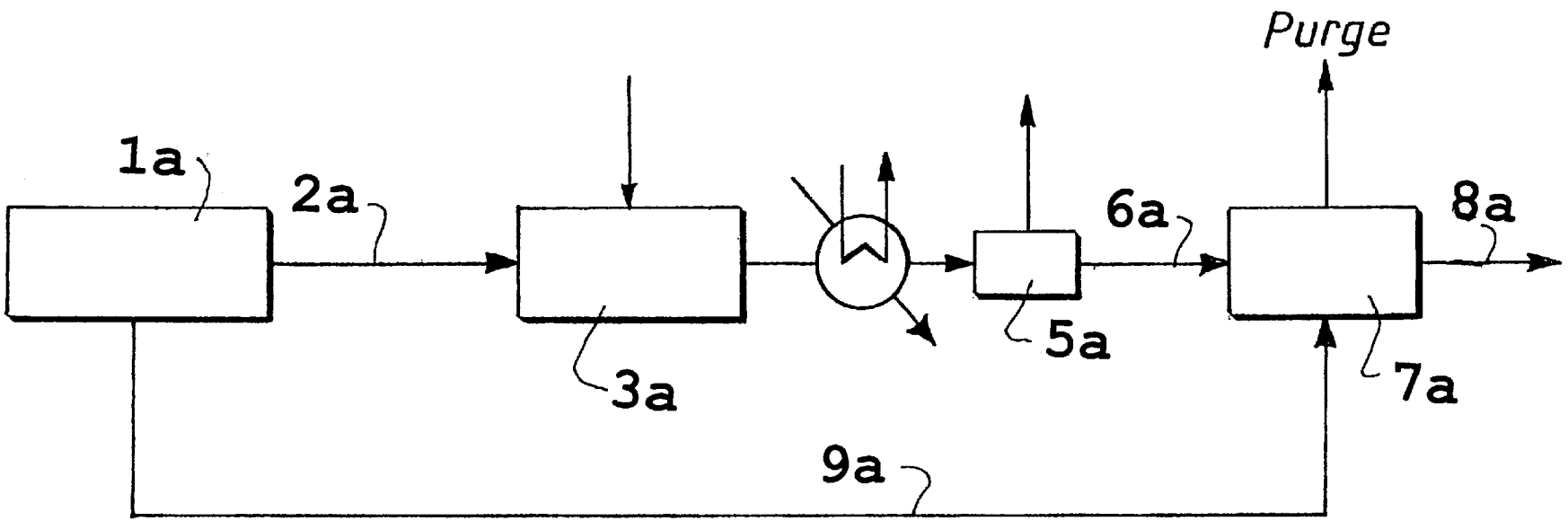
Figure 4:
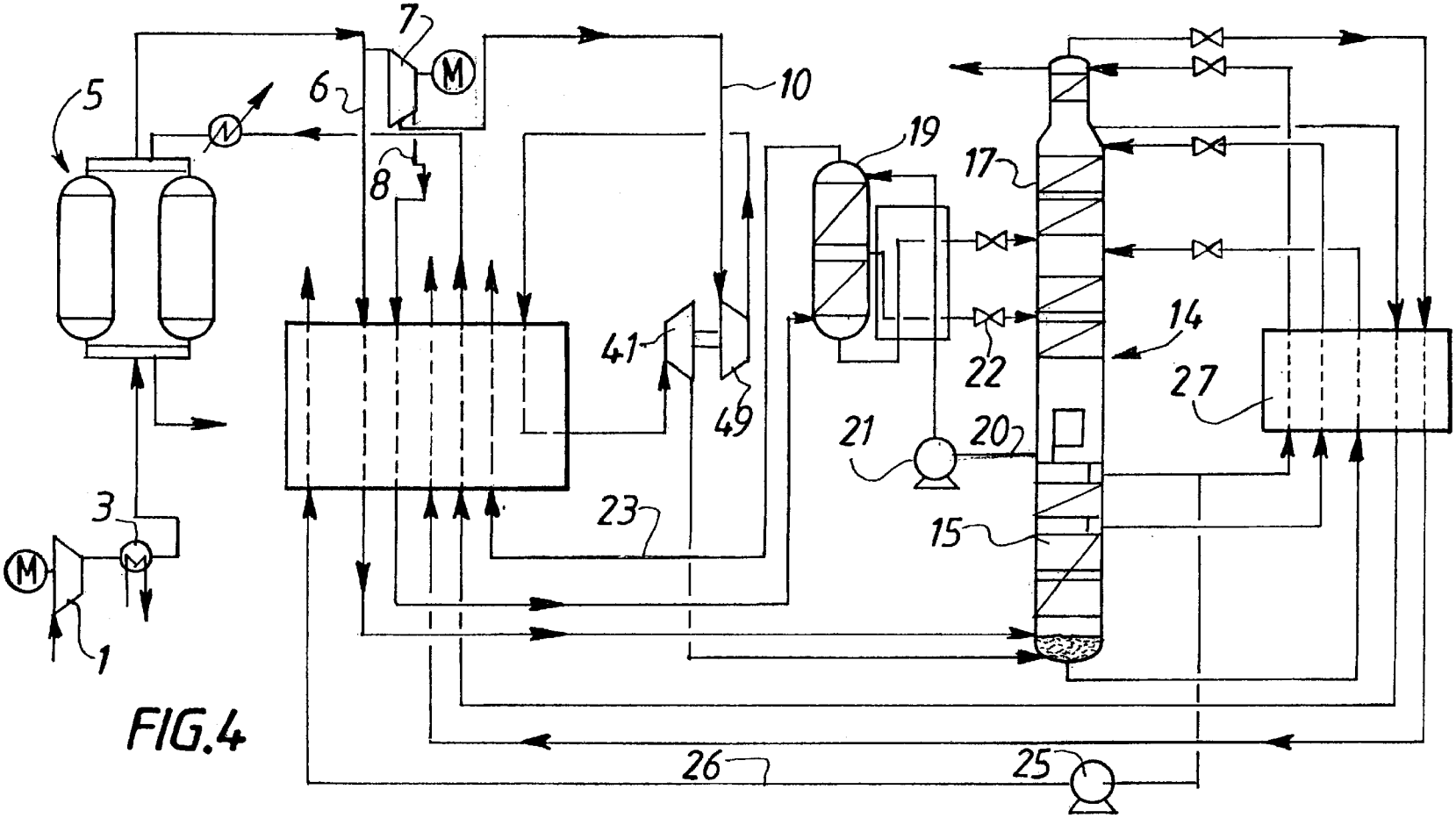

The invention will now be described in more detail with references to the figures, in which:

FIGS. 1, 2 and 4 are schematic diagrams of processes for supplying impure oxygen according to the invention, and FIG. 3 is a simplified diagram of an ammonia-synthesis process comprising a process for supplying impure oxygen according to the invention.

The synthesis-gas production unit preferably produces synthesis gas which is separated into a hydrogen-enriched part intended for the synthesis of ammonia. The impurities contained in the impure oxygen are essentially nitrogen which will take part in the ammonia-synthesis reaction.

An illustrative embodiment of the invention will now be described with reference to the appended drawing, the figure of which schematically represents an impure-oxygen production plant for carrying out a process according to the invention.

All of the air is compressed to 6 bar in a compressor 1, is cooled at 3 and purified with respect to water and carbon dioxide and hydrocarbons in adsorbent beds 5. The air is then divided into three fractions. The first fraction 6 is cooled to its dew temperature in the exchanger 13 and sent to the medium-pressure column 15 of a double column 14.

The second fraction 8 is boosted by the booster 7 to 11 bar, is cooled in the exchanger 13 and is sent to the base of a mixing column 19. The third fraction is boosted by the booster 9 to 8 bar, is cooled at 13 and expanded in the blower turbine 11 before being sent to the low-pressure column 17 of the double column. The mixing column may alternatively be fed at its base by a flow drawn off from the medium-pressure column.

A flow of 99% oxygen is drawn off from the base of the low-pressure column 14, pressurized to 11.8 bar by the pump 21 and sent to the head of the mixing column 19.

An impure oxygen flow 23 with 95% oxygen, 4% nitrogen and 1% argon is drawn off from the head of the mixing column, and a flow 22 is drawn off from an intermediate level of this column and returned to the low-pressure column.

A liquid nitrogen flow is drawn off from the head of the medium-pressure column, pressurized by the pump 25 and sent (at 26) to the exchanger 13, where it is vaporized.

It is obvious that this vaporization is not essential to the process. The nitrogen may be compressed by a compressor.

The process also makes it possible to produce low-pressure nitrogen 33 drawn off from the head of the minaret of the column 17. This nitrogen flow can be sent to the ammonia-synthesis unit.

Impure nitrogen at the low pressure is used to regenerate the adsorbent beds 5.

A liquid flow 31 is sent from the mixing column to the low-pressure column 17 a few plates above the injection point of the flow 22 and the injection point of the flow 10.

It may be advantageous to return the base flow from the mixing column instead to the medium-pressure column if the mixing column is operating at a pressure higher than that at which the medium-pressure column is operating (see FIG. 2, flow 30).

FIG. 3 shows the steps in a process for producing ammonia according to the invention. A device 1*a* for separating air by cryogenic distillation produces oxygen containing less than 1% argon and pure nitrogen. The oxygen is sent to a unit 3*a* where the hydrocarbons undergo a step of reforming or of partial oxidation. The synthesis-gas mixture is separated in a PSA 5*a* and the hydrogen via 6*a* is sent to the synthesis 7*a* of ammonia produced at 8*a* using the nitrogen 9*a* produced by the separation device 1*a*.

In FIG. 4, the air flow at 6 bar is divided into three. Fraction 6 is sent to the medium-pressure column 15 and fraction 8 is compressed by the compressor 7 with n stages. Fraction 10 is compressed by at most n-1 stages of the compressor 8 and then by the booster 49, cooled at 13 and expanded in a Claude turbine 41 before being sent to the medium-pressure column.

The turbine 11, 41 can produce a flow which is at least partially liquid.

The mixing column can operate at between 2 and 30 bar. It can operate at the same pressure as the low-pressure column or at a pressure above or below this value.

The plant in FIGS. 1, 2 and 4 can clearly comprise an argon column fed from the low-pressure column.

The percentages given for the contents of the impure oxygen in this application are molar percentages.

What is claimed is:

1. Process for supplying impure oxygen to a synthesis-gas production unit (3*a*) whose synthesis gas is separated into a hydrogen-enriched part intended for an ammonia-synthesis unit (7*a*), characterized in that the impure oxygen comes from a device (1*a*) for separating air by cryogenic distillation and contains 70 to 98% oxygen and less than 2% argon as fed to the synthesis-gas production unit.

2. Process according to claim 1, in which the impure oxygen contains 1 to 30% nitrogen.

3. Process according to claim 1, in which the impure oxygen contains between 75 and 85% oxygen.

4. Process according to claim 3, in which the impure oxygen contains 15 to 25% nitrogen.

5. Process according to claim 1, in which air is sent to a medium-pressure column of a double column (14) of the air-separation device (1), an oxygen-enriched liquid and a nitrogen-enriched liquid are sent from the medium-pressure column (15) to a low-pressure column (17) of the double column, air is sent to the base of a mixing column (19), an oxygen-enriched liquid (20) is sent from the low-pressure column to the head of the mixing column and the impure oxygen (23) is drawn off as product from the head of the mixing column.

6. Process according to claim 1, in which the synthesis-gas production unit (3*a*) is a reforming or partial-oxidation device.

7. Process for supplying impure oxygen to a synthesis-gas production unit (3*a*) whose synthesis gas is separated into a hydrogen-enriched part intended for an ammonia-synthesis unit (7*a*) and for supplying nitrogen (9) to the ammonia-synthesis unit, characterized in that the impure oxygen (2*a*) and the nitrogen come from a device (1*a*) for separating air by cryogenic distillation and the impure oxygen contains 70 to 98% oxygen and less than 2% argon as fed to the synthesis-gas production unit (3).

* * * * *